United States Patent [19]

Demange et al.

[11] 4,274,871

[45] Jun. 23, 1981

[54] METHOD OF OBTAINING MANGANESE ALLOYS WITH A MEDIUM CARBON CONTENT

[75] Inventors: Michel Demange; Louis Septier, both of Le Fayet, France

[73] Assignee: Societe Francaise d'Electrometallurgie-Sofrem, Paris, France

[21] Appl. No.: 108,844

[22] Filed: Dec. 31, 1979

[30] Foreign Application Priority Data

Jan. 22, 1979 [FR] France ..... 79 02574

[51] Int. Cl.[3] ..... C22B 47/00

[52] U.S. Cl. ..... 75/134 M; 75/80

[58] Field of Search ..... 75/80, 134 M, 60, 93 E, 75/49

[56] References Cited

U.S. PATENT DOCUMENTS

| | | | |
|---|---|---|---|
| 3,179,514 | 4/1965 | Kirby | 75/80 |
| 3,305,352 | 2/1967 | Day | 75/80 |
| 4,130,417 | 12/1978 | Breuer et al. | 75/60 |
| 4,139,370 | 2/1979 | Breuer et al. | 75/60 |
| 4,165,980 | 8/1979 | Breuer et al. | 75/60 |

FOREIGN PATENT DOCUMENTS

| | | | |
|---|---|---|---|
| 1499049 | 1/1978 | United Kingdom | 75/80 |

*Primary Examiner*—M. J. Andrews

*Attorney, Agent, or Firm*—McDougall, Hersh & Scott

[57] ABSTRACT

The invention concerns a method of obtaining manganese alloys with an average carbon content by reacting liquid, carbon-containing ferro-manganese in a fluid tight chamber. Oxygen, mixed with a heat regulating gas such as $CO_2$, air, nitrogen, argon or steam, is introduced and by controlling the discharge of the gaseous effluent, the pressure in the reactor is adjusted between 1.5 and 15 bars, to avoid volatilization of the manganese and a refined ferro-manganese is produced containing 0.5–2% carbon.

14 Claims, 2 Drawing Figures

METHOD OF OBTAINING MANGANESE ALLOYS WITH A MEDIUM CARBON CONTENT

The invention relates to a method of obtaining manganese alloys with a medium carbon content, particularly ferro-manganese alloys with a carbon content of from 0.5 to 2% by weight generally described as "refined ferro-manganese".

Manganese alloys intended for iron and steel metallurgy are produced by two broad types of process:

when alloys saturated with carbon are required, manganese ores are treated with one or more carbon-containing reducing agents in an electric or blast furnace;

when alloys not saturated with carbon are required there are two possible modes of operation:

(a) a silicon-containing manganese alloy (silico-manganese) is reacted with a manganese ore in the presence of lime; these reactions may take place in an electric furnace similar to those used in a steel works or in a ladle, after preliminary fusion of the manganese ore and lime;

(b) an alloy saturated with carbon is partially decarburized by an injection of oxygen in a reactor (this term referring generally to any refractory chamber appropriate to carrying out the metallurgical operation).

To avoid excessive losses of manganese by vaporization, the rise in temperature resulting from the chemical reactions is controlled as far as possible, by adding solid cooling agents, either directly at the surface of the reactor or suspended in the jet of oxygen gas.

A method of this type has been described in French Pat. Nos. 2 167 520 and 2 317 369 issued to Gesellschaft für Elektrometallurgie, GmbH.

Decarburization of manganese poses a difficult problem, because of the exceptional volatility of this element even at atmospheric pressure. If the curve for the vapor tension of manganese as a function of temperature is compared with the curve for the partial pressure of CO as a function of temperature, in the course of the reaction $MnO+\frac{1}{3}Mn_7C_3 \rightleftarrows 10/3\ Mn+CO$, the difference is found to be very narrow. It is not the same with chromium, so experts are able to decarburize chromium under a reduced partial pressure of CO, so as to lower the temperature at the beginning of the chromium decarburizing reaction, without entailing the risk of excessive losses of chromium. Unfortunately this solution cannot be applied to manganese, since it would lead to excessive losses by volatilization.

The invention is addressed to a method of obtaining manganese alloys, particularly ferro-manganese alloys with an average carbon content of from 0.5 to 2%, by decarburizing a bath of liquid ferro-manganese containing from 3 to 8% by weight of carbon and possibly up to 7% by weight of silicon, by the action of an oxidizing agent in a reactor, comprising introducing the oxidizing agent in the lower part of a bath of liquid ferro-manganese, which is kept at a pressure above atmospheric and preferably from 1.5 to 15 bars.

Applicants have found that the losses of manganese during decarburization by an oxidizing fluid were reduced commensurately with the increase in the temperature gap between the curve for the vapor tension of the manganese as a function of temperature and the curve indicating the partial pressure of CO as a function of temperature, for the reaction $MnO+\frac{1}{3}\ Mn_7C_3 \rightleftarrows 10/3\ Mn+CO$ at a given working pressure; in fact, the greater the difference in temperature, the less serious are the consequences of upsetting the thermal equilibrium, which is always fairly precarious in high temperature reactions.

Curve A shows the variation in the partial pressure of CO, as a function of temperature, in the reaction $MnO+\frac{1}{3}\ Mn_7C_3 \rightleftarrows 10/3\ Mn+CO$.

Curve B is the curve of equilibrium between the liquid manganese and the manganese vapor, that is to say, the variation in the vapor tension of the manganese as a function of temperature.

Curve C shows the temperature gap separating the decarbonization curve (A) from the manganese vaporization curve (B) as a function of pressure.

Figure 1:
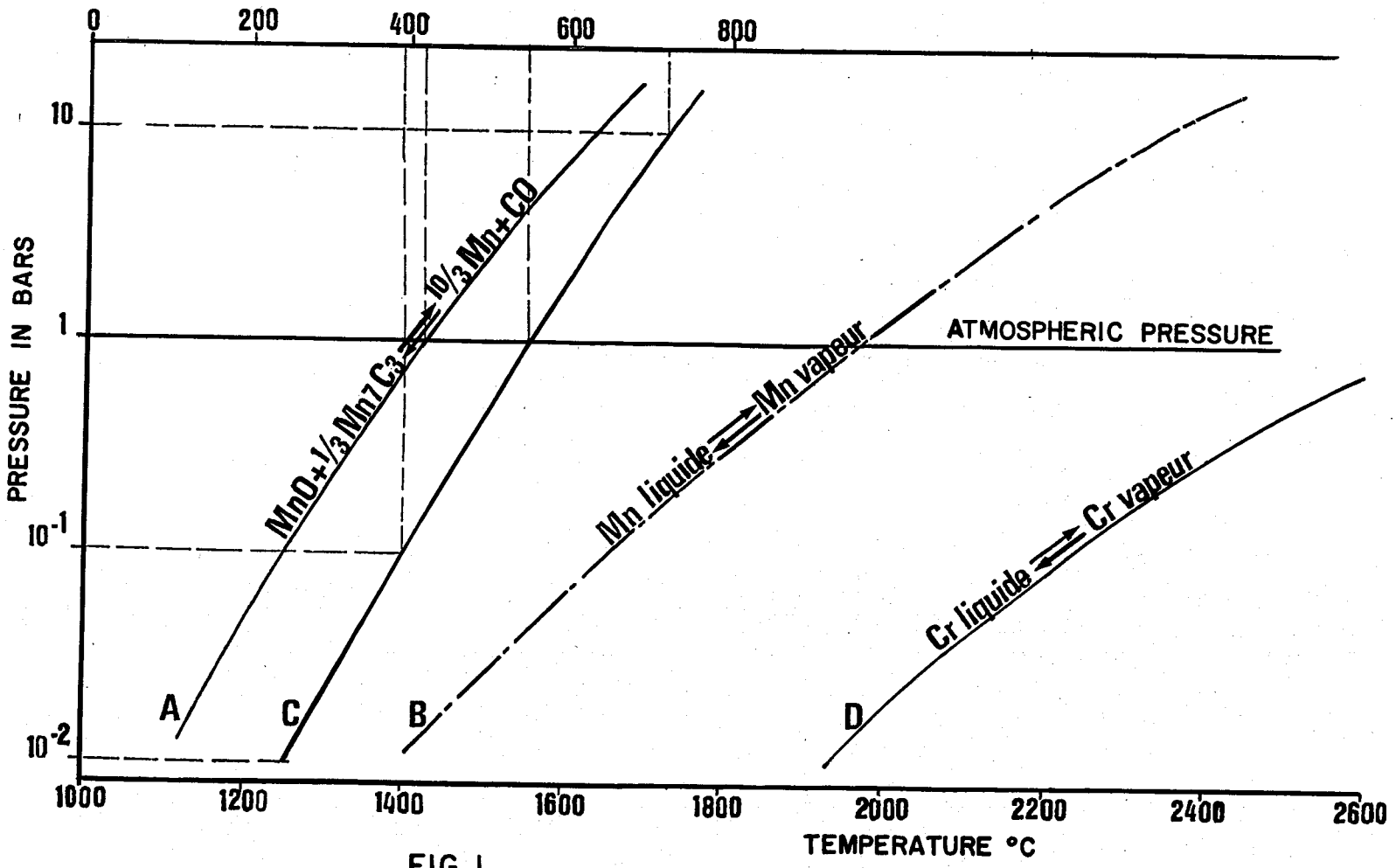
FIG. 1 is a graph showing temperatures in °C. on the X-axis and pressures in bars on the Y-axis.

Applicants have found that the difference in temperature, which is indicated on the upper scale in FIG. 1, increased with pressure. Thus, at a pressure of $10^{-2}$ atmospheres, there is a thermal margin of only approximately 250° C., whereas at a pressure of 10 atmospheres there is a thermal margin of over 700° C.

Curve D, which is given as a comparison, shows the variation in the vapor tension of chromium with temperature.

The oxidizing agent for carrying out the invention is pure oxygen. However, to avoid an excessive rise in temperature, which would cause both volatilization of manganese and rapid wear on the refractory lining of the reactor in the reaction zone, at least one heat regulating gas is added to the oxygen; this acts either as a ballast, as with air, nitrogen or argon, or both as a ballast and by the effect of endothermic dissociation, as with carbon dioxide and steam. By virtue of its dissociation into $CO+\frac{1}{2}\ O_2$ at the reaction temperature, carbon dioxide has the further advantage that it also acts as an oxidizing agent relative to both carbon and silicon.

The oxygen and carbon dioxide—or other heat regulating gas—may be injected simultaneously, mixed in variable proportions, or separately. It may be preferable to reduce the proportion of $CO_2$ in the gaseous mixture as the carbon content of the alloy treated decreases. The gas is preferably injected in the vicinity of one of the internal lateral walls of the reactor, but preferably near the bottom, so as to benefit from the hydrostatic pressure of the bath of liquid ferro-manganese and from the effect of trapping the manganese vapors in the upper layers of the bath, which are cooler.

In order to establish a pressure above atmospheric and up to 15 bars above the bath of ferro-manganese, the gaseous effluent is confined, either by fitting the reactor with a substantially fluid-tight cover, containing an aperture for the controlled discharge of the gases, or by enclosing the reactor in a substantially fluid tight chamber, also containing an aperture for controlled discharge of the gases; in either case, safety devices suitable for containers under pressure are provided, such as valves adjusted for release at a given pressure, as prescribed by the official regulations.

The application of the invention involves using a pressure of at least 1.5 bar absolute—that is to say, at least 0.5 bar above normal atmospheric pressure—and up to 15 bars absolute.

In practice, the preferred pressure range appears to be between 4 and 10 bars (absolute), and the best results are obtained by gradually raising the pressure commensurately with the reduction in the carbon content of the ferro-manganese, the final pressure being at least 1.5 times the initial pressure.

Apart from the oxidizing agent, it is desirable to place in the reactor an agent for scorifying the silica resulting from oxidation of the silicon generally present in ferro-manganese, in a quantity ranging from a fraction of 1% to about 7%. the scorifying agent may be lime, calcium carbonate, magnesia, magnesium carbonate, crude dolomite or calcined dolomite, used alone or mixed one with another.

In the case of lime, for example, the quantity is chosen so that the final $CaO/SiO_2$ ratio is from 0.8 to 2.5.

These additions can be made either with the material in a powdered state, suspended in the gases used for the treatment, or in pieces on the surface of the alloy to be treated.

An oxidized manganese compound may further be placed in the reactor, so that the danger of the metallic manganese scorifying can be limited, and so that any excessive increase in the temperature of the alloy during treatment can be controlled to a certain extent.

Finally, all or part of the dust—essentially consisting of oxidized manganese—resulting from filtering of the gaseous effluent from the reactor, may equally be recycled into the reactor.

Since this effluent is rich in carbon monoxide, it is often advantageous to exploit it by using it either as a fuel or as a raw material in other chemical or metallurgical operations.

The example which follows specifies the conditions under which the invention can be applied.

EXAMPLE

It is proposed to decarburize by this method 3.5 tons of carbon-containing ferro-manganese of the following composition:

Mn . . . 82.15%
C . . . 7.02%
Si . . . 0.37%
Fe . . . balance

Figure 2:
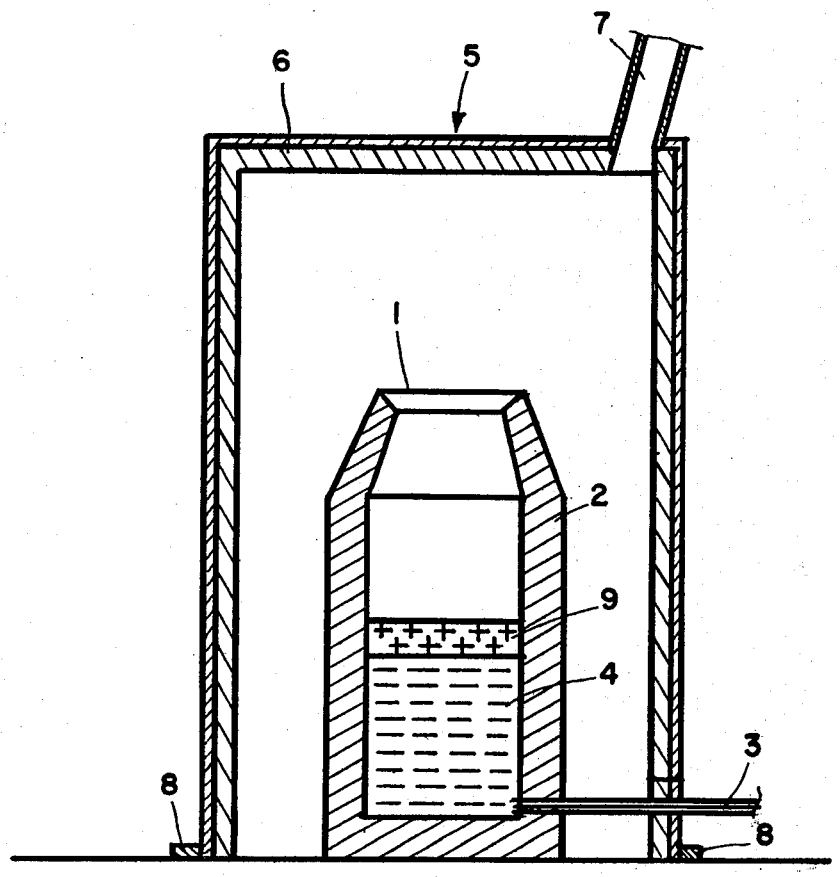
FIG. 2 is a diagram showing a reaction chamber for carrying out the method of the invention.

The treatment is carried out in a reactor shown in FIG. 2. The reactor 1 comprises a chamber of refractory magnesium compound 2 which is hot bonded by hydrocarbons (pitch and tar) and fired prior to any use.

The reactor has two concentric tuyers 3 at its base, through which the oxidizing fluids (oxygen and carbon dioxide) will be injected. Obviously, a certain amount of protective fluid is let in through the pipes before the alloy to be decarburized is placed in the reactor, in order to prevent the tuyers 3 from being obstructed by the alloy during filling.

When the alloy 4 to be refined has been placed in the reactor, the reactor is enclosed within a fluid tight chamber thick enough to withstand an excess pressure of 15 bars, taking into account the safety factors normally allowed.

The walls of the fluid tight chamber 5 are protected by an internal layer of insulating refractory material 6. The chamber 5 is fitted with an outlet aperture 7 for the discharge of the gases produced in the chemical reactions carried out in the reactor 1. The duration of the treatment is approximately 30 minutes, including the injection of 150 normal $m^3$ of oxygen and 100 normal $m^3$ of carbon dioxide.

At the beginning of the metallurgical operation, the valve for discharging the gaseous effluents is kept closed until a pressure of 5 bars is reached in the chamber 5.

The pressure maintained in 5 is modulated thus:

| | |
|---|---|
| during the first ten minutes of blowing: | 5 bars |
| from the tenth to the twentieth minute of blowing. | 8 bars |
| from the twentieth to the thirtieth minute of blowing: | 9 bars |

At the end of the injection of oxygen and $CO_2$, the tuyers are protected by injecting a small quantity of gas ($CO_2$, either pure or combined with a neutral gas) and the pressure is allowed to drop to atmospheric in the fluid tight chamber 5.

50 kg of powdered lime and 250 kg of the powdered substances collected during previous operations in the dust removing installation downstream of the gas discharge aperture 7 are successively suspended in the carbon dioxide, as cooling substances.

When the treatment is over, the seals 8 are dismantled and the chamber 5 removed. 2,900 kg of alloy 4, with 400 kg of slag 9 on top, is then found in the reactor. The composition of the slag is as follows:

$SiO_2$ . . . 7.5%
CaO . . . 12.5%
MgO . . . 7.5%
Mn oxides . . . 71.0%
Various . . . 1.5%

The slag is cleaned in a ladle, where it is treated with 100 kg of silico manganese containing 30.7% of Si. This second metallurgical treatment gives 320 kg of a new slag containing 28.5% of silica, 16.5% lime, 9.5% magnesia, 44% of manganese oxides and 1.5% of various constituents, in addition to 180 kg of ferro-manganese containing 1% of silicon and approximately 93% of manganese. This recovered alloy is added to the alloy 4 still contained in the reactor, in order to increase the total yield of manganese and to de-oxidize the decarburized metal with the silicon still contained in the recovered metal.

The synthesized alloy, thus obtained, is then cast in an ingot mold, weighed and analyzed. There is found to be 3,080 kg of an alloy containing 86.5% of manganese, 1.46% of carbon and 0.4% of silicon, with iron forming the balance.

The alloy thus obtained is a ferro-manganese with a low carbon content and a very low silicon content, which can be applied directly to the treatment of steels.

We claim:

1. A method of obtaining alloys based on manganese having a medium carbon content of from 0.5 to 2% by decarburization with a minimum loss of manganese, comprising decarburizing a bath of liquid ferro-manganese, containing from 3 to 8% of carbon and 0 to 7% of silicon, by the action of an oxidizing agent in a reactor, characterized in that the oxidizing agent is introduced in the lower part of the bath of liquid ferro-manganese and maintaining the bath at a pressure above 1.5 bars during the decarburization reaction.

2. The method as claimed in claim 1, in which the alloys based on manganese is a ferro-manganese alloy.

3. The method as claimed in claim 1, in which the pressure on the bath is maintained within the range of 1.5 to 15 bars.

4. The method as claimed in claim 1, characterized in that the bath of liquid ferro-manganese is kept at a pressure of from 4 to 10 bars.

5. The method as claimed in claim 1, characterized in that the pressure on the bath of liquid ferro-manganese is obtained, at least partially, by confining the gaseous effluents from the chemical reactions developed in the ferro-manganese by the oxidizing agent.

6. The method as claimed in claim 5, characterized in that the pressure on the bath of liquid ferro-manganese is modulated by acting on the discharge of the gaseous effluents.

7. The method as claimed in claim 6, characterized in that the reactor is fitted with a substantially fluid tight cover containing an aperture for controlled discharge of the gaseous effluents.

8. The method as claimed in claim 6, characterized in that the reactor is placed in a fluid tight chamber containing an aperture for controlled discharge of the gaseous effluents.

9. The method as claimed in claim 1, characterized in that, during the de-carbonization process, the pressure in the fluid tight chamber is gradually increased, commensurately with the reduction in the carbon content of the ferro-manganese, so that the final pressure is at least 1.5 times the initial pressure.

10. The method as claimed in claim 1, characterized in that the oxidizing agent is injected into the lower part of the bath of ferro-manganese.

11. The method as claimed in claim 1, characterized in that the oxidizing agent is pure oxygen with at least one heat regulating gas selected from the group consisting of carbon dioxide, air, nitrogen, argon and steam.

12. The method as claimed in claim 1, which includes the step of scorifying silica resulting from oxidation of the silicon with an agent selected from the group consisting of calcium oxide, calcium carbonate, magnesium oxide, magnesium carbonate, crude dolomite and calcined dolomite, by injecting the agent into the reactor for at least part of the time during which the oxidizing agent is being injected.

13. The method as claimed in claim 1, comprising injecting an oxidized manganese compound into the reactor.

14. The method as claimed in claim 1, comprising recycling at least part of the dust collected during the filtering of the gaseous effluents to the reactor.

* * * * *